US005558080A

United States Patent [19]

Grohman et al.

[11] Patent Number: 5,558,080

[45] Date of Patent: Sep. 24, 1996

[54] GREASE COLLECTING BAFFLE AND HEAT EXCHANGER ASSEMBLY FOR A WATER HEATING SYSTEM

[75] Inventors: Craig C. Grohman, Oak Creek; Edward Robinson, Caledonia, both of Wis.; Bob L. Barton, Camdenton, Mo.

[73] Assignee: Modine Manufacturing Company, Racine, Wis.

[21] Appl. No.: 430,756

[22] Filed: Apr. 27, 1995

Related U.S. Application Data

[62] Division of Ser. No. 320,949, Oct. 11, 1994, Pat. No. 5,524,607.

[51] Int. Cl.[6] ..... F24C 15/20

[52] U.S. Cl. ..... 126/299 D; 126/299 R; 55/269; 55/DIG. 36

[58] Field of Search ..... 126/299 R, 299 D, 126/301, 303, 299 E, 21 R; 165/166, 901; 55/DIG. 36, 269, 444, 443; 237/1 A, 8 R, 51

[56] References Cited

U.S. PATENT DOCUMENTS

| | | | |
|---|---|---|---|
| 3,260,189 | 7/1966 | Jensen | 55/269 |
| 3,369,349 | 2/1968 | Farr | 55/444 |
| 3,980,072 | 9/1976 | Jacobs | 126/299 D |
| 4,101,299 | 7/1978 | Bertucci | 126/299 E |
| 4,122,834 | 10/1978 | Jacobs | 126/299 D |
| 4,460,386 | 7/1984 | Diachuk | 126/299 E |

FOREIGN PATENT DOCUMENTS

| | | | |
|---|---|---|---|
| 4001548 | 7/1991 | Germany | 55/444 |

*Primary Examiner*—James C. Yeung
*Attorney, Agent, or Firm*—Wood, Phillips, VanSanten, Clark & Mortimer

[57] ABSTRACT

The energy required to provide hot water may be reduced in a water heating system including a heat generating range (12) for cooking food and a hood (14) overlying the range (12) for capturing fumes rising from the range (12) or the food thereon. An exhaust duct (16) provided with an exhaust fan (18) is connected to the hood (14) and a baffle and heat exchanger assembly (22) is interposed between the hood (14) and the exhaust duct (16). The assembly (22) includes a grease collecting baffle (54) facing the hood (14) and a heat exchanger (52) backing the baffle (54). The heat exchanger (52) includes a liquid flow path (56), (60), (74) through which water to be heated by the fumes may circulate.

15 Claims, 3 Drawing Sheets

GREASE COLLECTING BAFFLE AND HEAT EXCHANGER ASSEMBLY FOR A WATER HEATING SYSTEM

This is a division of application Ser. No. 08/320,949 filed Oct. 11, 1994, U.S. Pat. No. 5,524,607.

FIELD OF THE INVENTION

This invention relates to a water heating system, and more specifically, to a water heating system that operates principally on waste heat from a range.

BACKGROUND OF THE INVENTION

Restaurants and cafes generate large quantities of heat in the course of their operation. The heat results from the combustion of fuel or the operation of electrical resistance heaters, or both, used in the heating or cooking of food.

In cooking and heating processes, various gases, with or without particulates as in smoke, are generated. These gases are collectively referred to herein as "fumes" and may include one or more of gases of combustion resulting from the combustion of the fuel used to heat or cook the food, volatiles released by the food being heated or cooked, and water vapor from boiling or steaming containers or food, smoke resulting from the heating or cooking process, or resulting from the burning of food or parts thereof as, for example, the burning of fat released while cooking a steak over a grill.

As is well known, these fumes are typically exhausted from the vicinity of the range using an exhaust hood which overlies the range and which is connected to an exhaust duct leading to a point of discharge of the fumes. An exhaust fan is typically connected to the duct to create low pressure therein so that fumes rising from the range, and a certain amount of ambient air, are drawn into the exhaust hood and ultimately discharged elsewhere.

Upon consideration, those skilled in the art will recognize that the fumes being exhausted are typically at a temperature elevated well above ambient. To the extent that the fumes are simply discharged, their heat content is wasted. It has therefore been proposed to use the heat contained in the fumes for other purposes as, for example, in providing hot water which will typically be required by a restaurant operation for the washing of dishes and hands as well as for the operation of lavatories and the like.

At the same time, it has been recognized that grease contained in the fumes being exhausted must be disposed of. Current standards of the Underwriters Laboratory require the removal of at least four grams of grease for every gram of grease left on the typical filter employed in such systems during the exhausting of fumes.

The present invention is directed to providing a system that utilizes waste heat in the fume stream emanating from a range to provide hot water while at the same time removes sufficient grease from the stream so as to meet the standards of Underwriters Laboratory.

SUMMARY OF THE INVENTION

It is the principal object of the invention to provide a new and improved water heating system. More specifically, it is an object of the invention to provide a water heating system that makes extensive use of waste heat generated by a cooking operation.

It is also an object of the invention to provide a new and improved grease filter or baffle that efficiently removes grease from range fumes as they are being exhausted.

An exemplary embodiment of the invention, in one facet thereof, achieves the foregoing objects in a construction that includes a heat generating range for cooking food. A hood overlies the range for capturing fumes rising from the range or the food thereon and an exhaust duct is connected to the hood so that the fumes may be exhausted. An exhaust fan is connected to the exhaust duct for causing the fumes to be exhausted.

A baffle and heat exchanger assembly is interposed between the hood and the exhaust duct. The assembly has a grease collecting baffle facing the hood and a heat exchanger backing the baffle. The heat exchanger has a first flow path for the fumes and a second flow path in heat exchange relation with the first flow path. The second flow path has opposed ends. One end is adapted to receive water to be heated and the other end is adapted to discharge water heated by the fumes.

In a preferred embodiment, the heat exchanger is mounted in the hood and the baffle is removably attached to the heat exchanger.

In a highly preferred embodiment, the invention includes a frame at least partially surrounding the heat exchanger. The frame has a depth sufficient to receive both the heat exchanger and the baffle. The heat exchanger is disposed in the frame and the baffle is removably nested in the frame so as to be disposed across the first flow path of the heat exchanger.

The invention contemplates that the frame include a opposed upper and lower channels, the channels opening toward each other. The channels receive and are secured to the heat exchanger while the baffle is removably received in the channels.

According to one embodiment of the invention, the baffle comprises two spaced plates, each having louvers therein. The louvers on one plate are staggered with respect to the louvers on the other plate.

In a preferred embodiment, the plates are generally planar and the louvers include wings displaced from the plane of the associated plate toward the plane of the other plate.

Preferably, at least some of the wings on one of the plates include tabs directed toward, and in at least nominal contact with, the other of the plates.

In a highly preferred embodiment, some of the wings on both of the plates are provided with the tabs.

In one embodiment, the invention further contemplates the provision of a water heater having an upper, hot water outlet, a cold water inlet and a recirculating water inlet. The second flow path end adapted to receive the water to be heated is connected to the hot water outlet of the water heater while the other end of the heat exchanger is connected to the recirculating water inlet.

As a consequence of the foregoing, water will circulate through the heat exchanger by thermosiphoning. To the extent that waste heat may not be sufficient to heat water to the desired degree, the water heater acts as a supplemental source of heat to assure that a constant supply of hot water is available.

In another facet, the invention contemplates the provision of a grease collecting baffle and heat exchanger assembly. The assembly includes a frame adapted to be mounted in a range hood, a heat exchanger including a gas flow path and a liquid flow path in heat exchange relation therewith, with the heat exchanger being mounted in the frame so that when mounted in a range hood, range fumes may pass through the gas flow path. The assembly also includes a grease collecting baffle removably mounted in the frame and in substantial abutting relation with the heat exchanger.

In a highly preferred embodiment, the baffle and heat exchanger assembly uses a frame made of opposed channels. Each of the channels has a base and at least one leg extending therefrom towards the other of the channels. The channels are secured to the heat exchanger such that each leg is spaced to one side of the heat exchanger a distance at least slightly greater than the thickness of the baffle. The baffle is thus removably nested between the channels and sandwiched by the legs and the adjacent side of the heat exchanger.

Preferably, the channels are upper and lower channels and at least the lower channel includes a grease draining aperture.

Other objects and advantages will become apparent from the following specification taken in connection with the accompanying drawings.

DESCRIPTION OF THE PREFERRED EMBODIMENT

Figure 1:
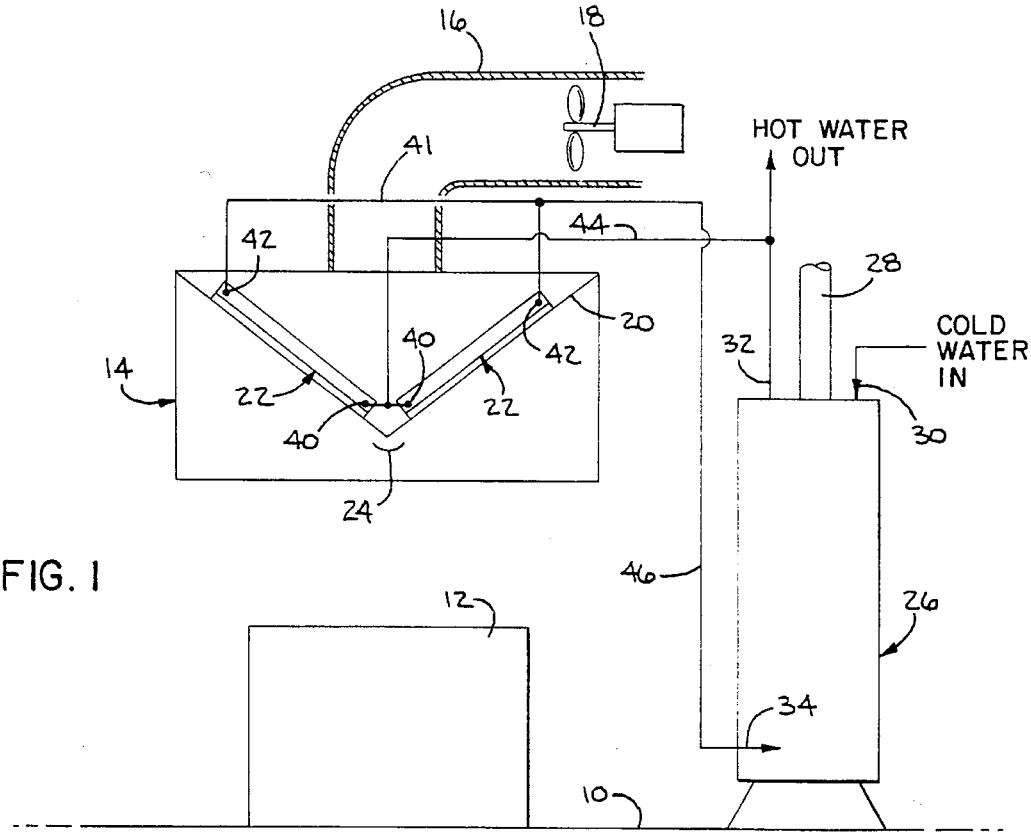
FIG. 1 is a somewhat schematic elevational view of a water heating system made according to the invention.

An exemplary embodiment of a water heating system made according to the invention is illustrated in FIG. 1. Resting on a building floor 10 is a conventional range 12. In the usual case, the range 12 will combust a fuel such as natural gas that generates heat for the heating or cooking of food. However, the range 12 could be partly or wholly electrical, using electrical resistant elements to generate heat for the same purpose.

Overlying the range 12 is an exhaust hood, generally designated 14. The exhaust hood 14 is conventionally configured so as to capture fumes rising from the range 12, whether the fumes be gases of combustion or vapors or smoke generated by the heating, cooking or burning of food or parts thereof.

An exhaust duct 16 connected to the hood 14 and is provided with a motor driven exhaust fan 18. The fan 18 creates a low pressure area within the hood 14 so that the latter will collect fumes rising from the range 12. The fan 18 also directs the fumes through the duct 16 to a point of discharge.

Within the hood is a V-shaped partition 20. The partition 20, along both of its legs, includes several openings along its length and within each opening is a grease collecting baffle and heat exchanger assembly, generally designated 22, and made according to the invention. Thus, each assembly 22 is interposed between the hood 14 and the exhaust duct 16.

As will be seen, a baffle forming part of the assembly collects grease in the fumes and accordingly, a grease trough 24 is disposed below the apex of the V-shaped partition 20 to collect grease dripping therefrom.

Also included in the system is a conventional water heater, generally designated 26. The water heater 26 may be electrically operated or may operate on natural gas or the like. In the case of the latter, the same will be provided with a flue 28.

The water heater 26 has a cold water inlet 30 and an upper, hot water outlet 32.

In addition, a lower, recirculating water port 34 is provided. The recirculating water port 34 may be provided through use of the conventional lower water drain in a water heater as a recirculating water port in addition to functioning as a drain.

Each of the assemblies 22 includes an inlet 40 for water to be heated and an outlet 42 for heated water. A conduit 44 extends from the hot water outlet 32 to the inlets 40 while a conduit 46 extends from the outlets 42 to the recirculating water port 34. As a consequence of the foregoing arrangement, a water circulating loop that will operate without a pump by the phenomenon known as "thermosiphoning" is formed. That is to say, whenever heat is added to the water within the assemblies 22, it will cause the water to circulate in the loop just described including the conduit 44 and 46, the heat exchangers in the units 22 and the water heater 26. If desired, however, a pump and accumulator system (not shown) could be used to enhance circulation, or as a complete alternative. Fumes entering the hood 14 pass through the assemblies 22 and heat the water in the heat exchanger thereof. The water heated in the assemblies 22 is delivered to the water heater 26 and the to the extent that the temperature of the water so delivered exceeds the temperature set point of the water heater 26, the latter will act simply as a storage vessel for the hot water. If, however, the temperature of the water thus delivered is below the set point of the water heater 26, the heater 26 will operate to increase the temperature of the water to the set point. In either event, a substantial quantity, if not all of the heat necessary to heat the water, is provided by the heating of the water within the assemblies 22 by hot fumes rising from the range 12 as they are exhausted by the exhaust fan 18.

At the same time, the baffles within the assemblies 22 remove grease from the rising fumes and promote uniform distribution of the fumes across the heat exchanger of each assembly 22.

Turning to FIGS. 2–7, an exemplary embodiment of one of the grease collecting baffle and heat exchanger assemblies 22 will be described.

Each assembly 22 is made up of three basic components. The first is a rectangular frame, generally designated 50, while the second is a plate fin-round tube heat exchanger, generally designated 52, contained within the frame and secured thereto as by rivets (not shown). The third and final component is a grease collecting baffle, generally designated 54, which is removably nested within the frame 50 in substantial abutment with the heat exchanger 52.

Figure 2:
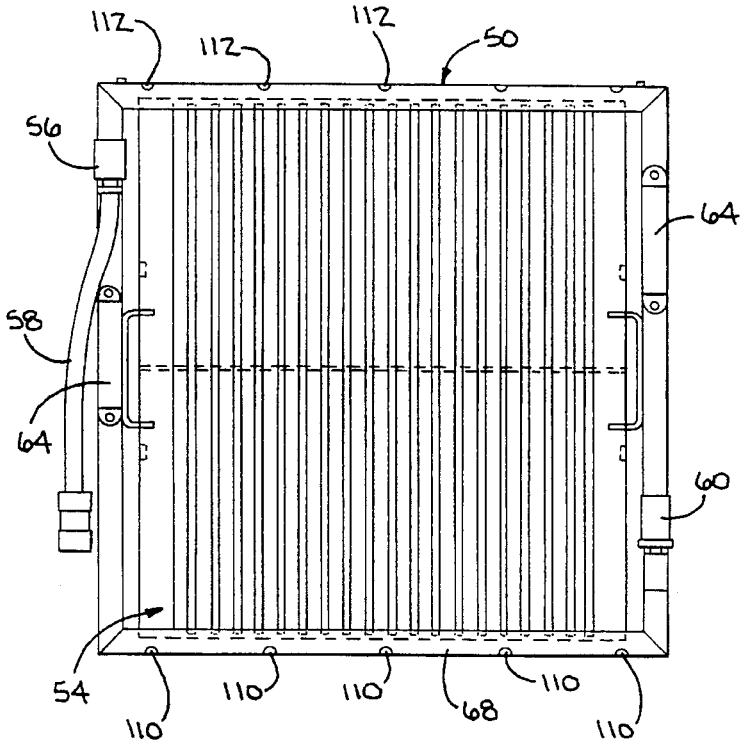
FIG. 2 is an elevation of a grease collecting baffle and heat exchanger assembly used in the invention.

As seen in FIG. 2, a fitting 56 extends through the frame and serves as the inlet 40 to the heat exchanger 52. It is connected to a piece of flexible conduit 58 to ease assembly operations.

A further fitting 60 on the frame serves as the heat exchanger outlet 42. A pressure relief valve (not shown) is mounted on the fitting 56. One or more manipulating handles 64 are secured to the frame.

Figure 3:
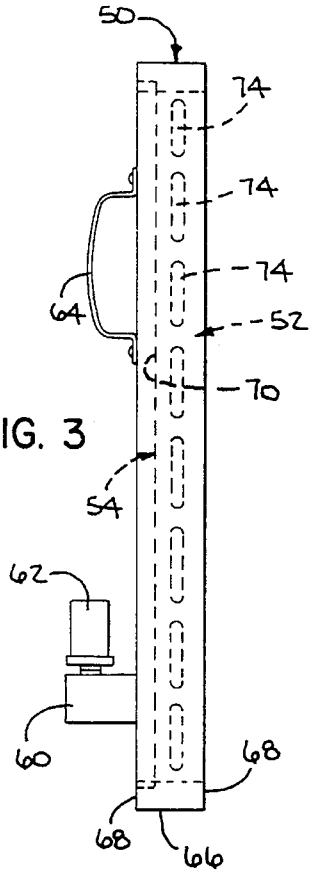
FIG. 3 is a side elevation of the assembly of FIG. 2.

The frame 50 is made up of conventional channels. As seen in FIG. 3, each channel includes a base 66 and spaced legs 68. The opposite sides of the channels defining the frame 50 open towards each other. The spacing between the legs 68 is such that, as seen in FIG. 3, the heat exchanger 52 and the baffle 54 will fit between them. This allows the baffle 54 to be removably nested between one of the legs 66 and the facing side 70 of the heat exchanger 52.

Figure 5:
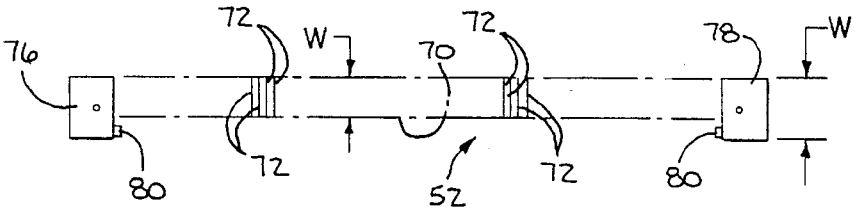
FIG. 5 is a plan view of the heat exchanger.
Figure 4:
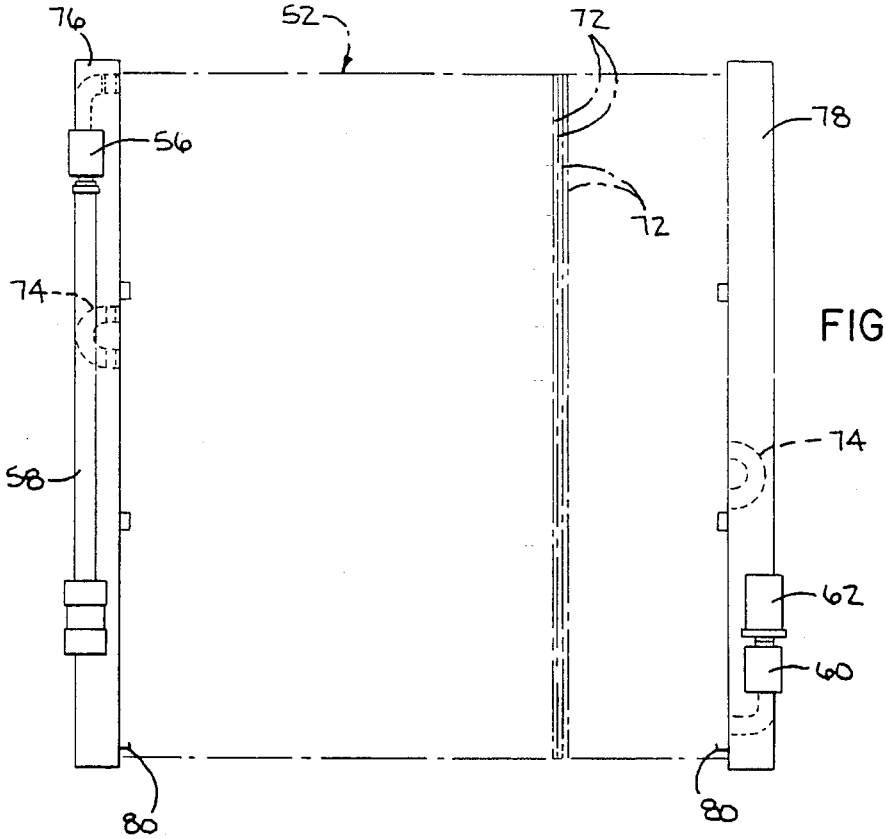
FIG. 4 is an elevation of a heat exchanger forming part of the assembly of FIG. 2.

FIGS. 4 and 5 illustrate the heat exchanger 52 in somewhat greater detail. As noted previously, the heat exchanger is a plate fin-round tube heat exchanger and includes a plurality of plate fins 72 impaled on round tubes (not shown) and disposed in vertical planes. The construction is generally conventional and at the ends of the resulting core, 180° elbows 74 join ends of adjacent tubes so that a sinuous water flow path is defined by the round tubes and the elbows 74. A gas flow path is, of course, defined by plate fins 72 and the spaces between adjacent fins 70.

Vertically extending end pieces 76 and 78 house the elbows 74 on opposite sides of the core. As seen in FIG. 5, the end pieces 76 and 78 have a width 'W' that is greater than the width 'w' of the core defined by the plate fins 72 and the round tubes. The difference in width is approximately equal to the width of the baffle 54, the precise dimension depending upon how snugly the end pieces 76 and 78 of the heat exchanger 52 are received within the frame 50. The difference must be sufficient so as to enable the baffle 54 to be relatively easily mounted in or removed from the frame 50.

Near their lower ends, at a location displaced to the side 70 of the core, the end pieces mount supporting tabs 80. The tabs 80 are located so as to be below the upper extremity of the legs 68 of the bottom channel of the frame 50 so that the baffle 54 may be supported by the tabs 80 in the position illustrated in dotted lines in FIG. 3.

Figure 7:
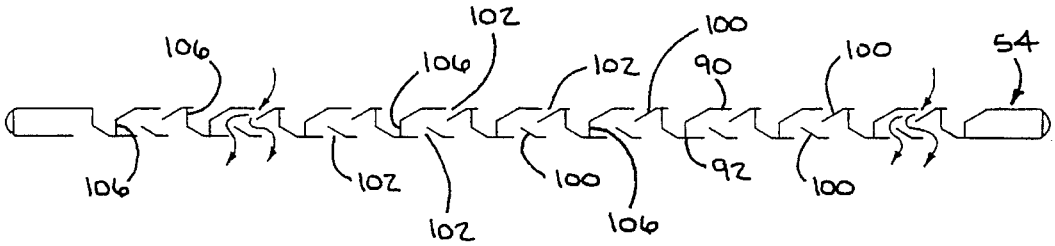
FIG. 7 is a sectional view taken approximately along the line 7—7 in FIG. 6.
Figure 6:
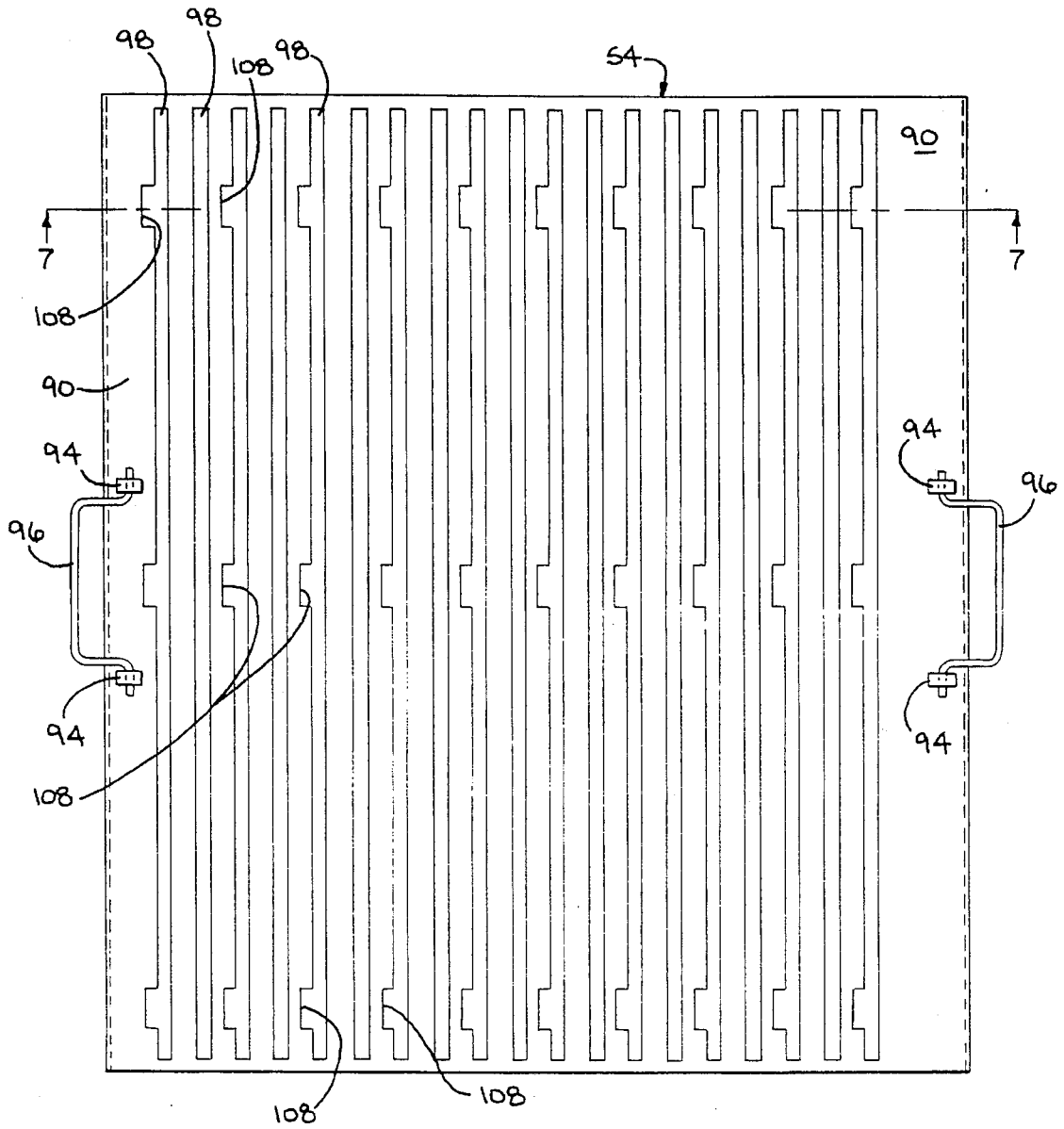
FIG. 6 is an elevation of the grease collecting baffle used in the assembly.

FIGS. 6 and 7 illustrate the construction of the grease collecting baffle 54. As perhaps best seen in FIG. 7, the same is fabricated of two, relatively thin, planar metal plates 90 and 92. Except for the fact that the front plate 90 has aligned eyes 94 (FIG. 6) struck in it to mount wire handles 96, the plates 90 and 92 may be regarded as identical.

Formed in each plate is a series of elongated, vertically directed louvers 98. The louvers 98 are vertically oriented so as to facilitate the flow of grease to the bottom of the baffle 54.

Each of the louvers 98 is formed by, for example, stamping to provide and elongated wing 100 that is displaced from the plane of the associated plate toward the other of the plates. In a typical case, the displacement angle will be 30° from the plane of the associated plate.

As seen in FIG. 7, the wings 100 in the plate 90 are staggered with respect to the wings 100 in the plate 92. Moreover, the stamping operation results in openings 102 at the location in each of the plates 90, 92 whereat the wings are displaced from the associated plate. As a consequence, the openings 102 are staggered and flow paths such as those indicated by arrows of a somewhat tortuous configuration result. It has found that such provides for excellent grease collection by disentraining grease from the fumes. In particular, it has been found that 7 grams of grease are collected for each gram left on the baffle 54 where the heat exchanger 52 has water flowing through it. Conversely, if water flow is halted, the grease collection ratio increases to about 35 to 1.

Further, the baffle 54 promotes uniform distribution of the fumes across the heat exchanger 52. This enhances the heat transfer operation and considerably improves efficiency.

In order to assure that the plates 90 and 92 do not collapse upon one another, every other one of the wings 100 on both of the plates includes three tabs 106 which extend from the end of the respective wing 100 remote from the plane of the plate 90 or 92 the direction generally transverse to such plane. The arrangement is such that the tabs 106 come into nominal contact (which can include actual contact) with the opposite one of the plates 90 and 92 so as to preserve spacing therebetween. The tabs 106 are located generally at the top, center and bottom of the associated wings 100.

The three rows of the tabs 106 are so located, as can be ascertained from FIG. 6 as indicated by notches 108 in the plane of the plate 90 from which the tabs 106 are formed.

As noted previously, the louvers 98 are intended to be generally vertically elongated to facilitate the drainage of grease. In this regard, and referring to FIG. 2, the lower channel of the frame 50 is provided with a series of apertures 110 in both of the legs 68. The apertures 110 extend to the base 66 and serve the purpose of providing drain holes for any grease that is captured by the channel so that it may drain into the grease trough 24 (FIG. 1).

From the foregoing it will be appreciated that a water heating system made according to the invention is highly advantageous. It has been estimated that in a typical installation, the cost of installing the baffle and heat exchanger assemblies 22 can be recaptured in approximately one year by savings in the cost of fuel for operating the water heater 26. This, of course, means that system is environmentally friendly in terms of reducing fuel consumption, and thus, reducing the introduction of combustion gases into the atmosphere.

Furthermore, the unique grease collecting baffle performs very well in terms of removing large amounts of grease from the fumes being exhausted. As a consequence, there is a reduced possibility of the discharge of pollutants and reduced maintenance in terms of reducing the frequency with which the baffle 54 must be cleaned.

In most cases, for routine maintenance, it is only necessary to remove the baffle 54 from the frame. This may be accomplished by holding the wire handles 96 and lifting the baffle 54 within the frame 50 until the lower edge of the baffle is above the channel leg 68. At this point, the lower end may then be swung outwardly out of the frame and the baffle 54 lowered to be free from the frame for easy cleaning. Of course, it will be desirable to occasionally clean the heat exchanger 52 as well but for routine maintenance, only the baffle 54 need be cleaned.

Finally, those skilled in the art will recognize hoods 14 are not only used with ranges 12, but with other cooking devices as well, as, for example, deep fat fryers. The unique construction of the baffle and heat exchanger assembly 22 is ideally suited for use in the environment of a deep fat fryer. It will function as described above and offers the advantage that should the heat exchanger 52 burst or spring a leak, the baffle 54 will intercept the water before it can descent to the deep fat fryer and divert it to the grease collection trough 24. Consequently, the undesirable mixing of water and hot oil is avoided, thereby extending the usefulness of the system.

We claim:

1. A water heating system comprising:

a heat generating range for cooking food;

a hood overlying said range for capturing fumes rising from the range or food thereon;

an exhaust duct connected to said hood whereby said fumes may be exhausted therefrom;

an exhaust fan connected to said exhaust duct for causing said fumes to be exhausted;

a water heater having an upper, hot water outlet, a cold water inlet and a recirculating water port; and a baffle and heat exchanger assembly interposed between said hood and said exhaust duct, said assembly having a grease collecting baffle facing said hood and a heat exchanger backing said baffle, said heat exchanger having a first flow path for said fumes and a second flow path for water to be heater and in heat exchange relation with said first flow path, said second flow path having opposed ends, one of said ends being connected to said hot water outlet, the other of said ends being connected to said recirculating water port.

2. A water heating system comprising:

a hood adapted to overlie a cooking range for capturing fumes rising from the range or food thereon;

an exhaust duct connect to said hood whereby said fumes may be exhausted therefrom;

an exhaust fan connected to said exhaust duct for causing said fumes to be exhausted; and a baffle and heat exchanger assembly interposed between said hood and said exhaust duct, said assembly having a grease collecting baffle facing said hood and a heat exchanger backing said baffle; said heat exchanger having a first flow path for said fumes and a second flow path in heat exchange relation with said first flow path, said second flow path having opposed ends, one end for receiving water to be heated and the other end for discharging water heated by said fumes, said heat exchanger being mounted in said hood and said baffle being removably attached to said heat exchanger and further including a frame at least partially surrounding said heat exchanger, said frame having a depth sufficient to receive both said heat exchanger and said baffle, said heat exchanger being disposed in said frame and said baffle being removably nested in said frame so as to be disposed across said first flow path.

3. The water heating system of claim 2 wherein said frame includes opposed, upper and lower channels, said channels opening toward each other, said channels receiving said heat exchanger and said baffle being removable received in said channels.

4. The water heating system of claim 2 wherein said frame includes opposed channels receiving said baffle, and apertures in at least one of said channels for draining grease collected by said baffle.

5. A water heating system comprising:

a hood adapted to overlie a cooking range for capturing fumes rising from the range or food thereon;

an exhaust duct connected to said hood whereby said fumes may be exhausted therefrom;

an exhaust fan connected to said exhaust duct for causing said fumes to be exhausted; and a baffle and heat exchanger assembly interposed between said hood and said exhaust duct, said assembly having a grease collecting baffle facing said hood and a heat exchanger backing said baffle; said heat exchanger having a first flow path for said fumes and a second flow path in heat exchange relation with said first flow path, said second flow path having opposed ends, one end for receiving water to be heated and the other end for discharging water heated by said fumes; said baffle comprising two spaced plates, each having louvers therein, the louvers in one plate being staggered with respect to the louvers in the other plate, the plates being generally planar and the louvers including wings displaced from the plane of the associated plate toward the plane of the other plate, at least some of said wings on one of said plates including tabs directed toward, and in at least nominal contact with, the other of said plate.

6. The water heating system of claim 5 wherein some of the wings on both of said plates have said tabs.

7. A grease collecting baffle and heat exchanger assembly for use in a water heating system comprising:

a frame adapted to be mounted in a range hood;

a heat exchanger including a gas flow path and a liquid flow path in heat exchange relation with each other, said heat exchanger being mounted in said frame so that when mounted in a range hood, range fumes may flow through said gas flow path;

and a grease collecting baffle removably mounted in said frame in substantial abutting relation with said heat exchanger.

8. The assembly of claim 7 wherein said frame includes opposed channels, each of said channels having a base and at least one leg extending therefrom toward the other of said channels, said channels being secured to said heat exchanger such that each said leg is spaced to one side of the heat exchanger a distance at least slightly greater than the thickness of said baffle, said baffle being removably nested between said channels and sandwiched by said legs and said heat exchanger one side.

9. The assembly of claim 8 wherein said channels are upper and lower channels and at least said lower channel includes grease draining apertures.

10. The assembly of claim 9 wherein said baffle comprises two spaced plates, each having louvers therein, the louvers in one plate being staggered with respect to the louvers in the other plate.

11. The assembly of claim 10 wherein said plates are generally planar and said louvers include wings displaced from the plane of the associated plate toward the plane of the other plate.

12. The assembly of claim 11 wherein at least some of said wings on one of said plates include tabs directed toward, and in at least nominal contact with, the other of said plates.

13. The assembly of claim 12 wherein some of the wings on both of said plates have said tabs.

14. The assembly of claim 7 wherein said heat exchanger is a plate fin-round tube heat exchanger, with plate fins defining said gas flow path and round tubes defining said liquid flow path.

15. The assembly of claim 14 wherein said plate fins are in vertical planes.

* * * * *